United States Patent [19]

Killinger

[11] 4,411,210

[45] Oct. 25, 1983

[54] ACTUATING MECHANISM FOR A DOUBLE POINTED LOOPER IN A SEWING MACHINE

[75] Inventor: Karl H. Killinger, Dover, N.J.

[73] Assignee: The Singer Company, Stamford, Conn.

[21] Appl. No.: 331,699

[22] Filed: Dec. 17, 1981

[51] Int. Cl.[3] ..... D05B 57/02; D05B 97/02; D05B 97/10

[52] U.S. Cl. ..... 112/199; 112/169

[58] Field of Search ..... 112/159, 165, 166, 169, 112/197, 199

[56] References Cited

U.S. PATENT DOCUMENTS

| | | | |
|---|---|---|---|
| 1,809,192 | 6/1931 | Cahill et al. | 112/169 |
| 2,410,679 | 11/1946 | Pikul | 112/159 |
| 3,165,080 | 1/1965 | Castelletti | 112/169 X |
| 3,435,789 | 4/1969 | Kuramochi | 112/169 |

FOREIGN PATENT DOCUMENTS

| | | | |
|---|---|---|---|
| 1081375 | 6/1954 | France | 112/169 |

*Primary Examiner*—Wm. Carter Reynolds

*Attorney, Agent, or Firm*—David L. Davis; Robert E. Smith; Edward L. Bell

[57] ABSTRACT

An actuating mechanism for a double pointed looper wherein the vertical reciprocating motion of a drive pin is converted into a controlled back and forth pivoting motion of the looper in a single thread chain stitch sewing machine.

4 Claims, 18 Drawing Figures

ACTUATING MECHANISM FOR A DOUBLE POINTED LOOPER IN A SEWING MACHINE

DESCRIPTION

BACKGROUND OF THE INVENTION

This invention relates to chain stitch sewing machines and, more particularly to double pointed looper mechanisms for such sewing machines.

Single thread, chain stitch sewing machines utilizing double pointed loopers are commonly used in machines for sewing buttons onto garments and sewing a series of substantially superimposed stitches for tacking together multiple pieces of material. Such machines are well known in the art. See, for example, U.S. Pat. No. 2,410,679, issued Nov. 5, 1946 to Pikul which discloses a double pointed looper mechanism actuated by a rotary cam which in turn is driven through a worm and worm gear coupling to the arm shaft. This mechanism is relatively complex and costly to manufacture. A simpler, more compact mechanism for driving a double pointed loop is disclosed in U.S. Pat. No. 3,165,080, issued Jan. 12, 1965 to Castellitti. This patent discloses an actuating mechanism for the looper comprising a looper biasing spring having one end attached to the looper and the other end attached to a shiftable base plate. As the base plate is shifted in one direction or the other by operation of the feed mechanism, the spring causes the looper to pivot slightly off center in one direction or the other in correspondence thereto. A V shaped slot formed in the looper serves as a cam track for a drive pin which is made to oscillate vertically along an arcuate path, thereby tilting the looper alternately in one direction, then the other. A disadvantage of this type of construction is that the drive pin does not positively track the V shaped slot and may become lodged on the lower point of the V shaped slot under certain conditions. This potential problem could be obviated by providing a positive blocking of alternately one side of the V shaped slot then the other so that the drive pin must track the side of the V shaped slot that is not blocked.

It is therefore an object of this invention to provide a double pointed looper actuating mechanism wherein the drive pin positively tracks the looper pivoting cam.

It is another object of this invention to provide a double pointed looper actuating mechanism of simple construction, and few parts, that is relatively inexpensive to manufacture and maintain.

Other objects and advantages of the invention will become apparent through reference to the accompanying drawings and descriptive matter which illustrates a preferred embodiment of this invention.

SUMMARY OF THE INVENTION

According to the present invention, there is provided a sewing machine having a frame, a thread carrying needle arranged for reciprocating motion in the frame and a looper having two loop seizing points arranged for pivotal motion in the frame. An actuating means is included for effecting these motions thereby alternately placing each of the two loop seizing points into cooperative engagement with the needle in the formation of chain stitches. The actuating means comprises: a guide member having an elongated guide channel; an actuating member constrained in said elongated guide channel; means for imparting reciprocatory motion to said actuating member along said elongated guide channel; a cam rigidly attached to the looper; the cam having two intersecting cam tracks; cam follower means associated with the actuating member and arranged in sliding engagement with the cam tracks; and a gate means for alternately blocking each of the two intersecting cam tracks so that the cam follower will slidingly engage the other of the two intersecting cam tracks thereby effecting the pivotal motion of the looper.

BRIEF DESCRIPTION OF THE DRAWINGS

In order that the invention be more fully understood, it will now be described, by way of example, with reference to the following drawings in which.

DESCRIPTION OF THE PREFERRED EMBODIMENT

Figure 2:
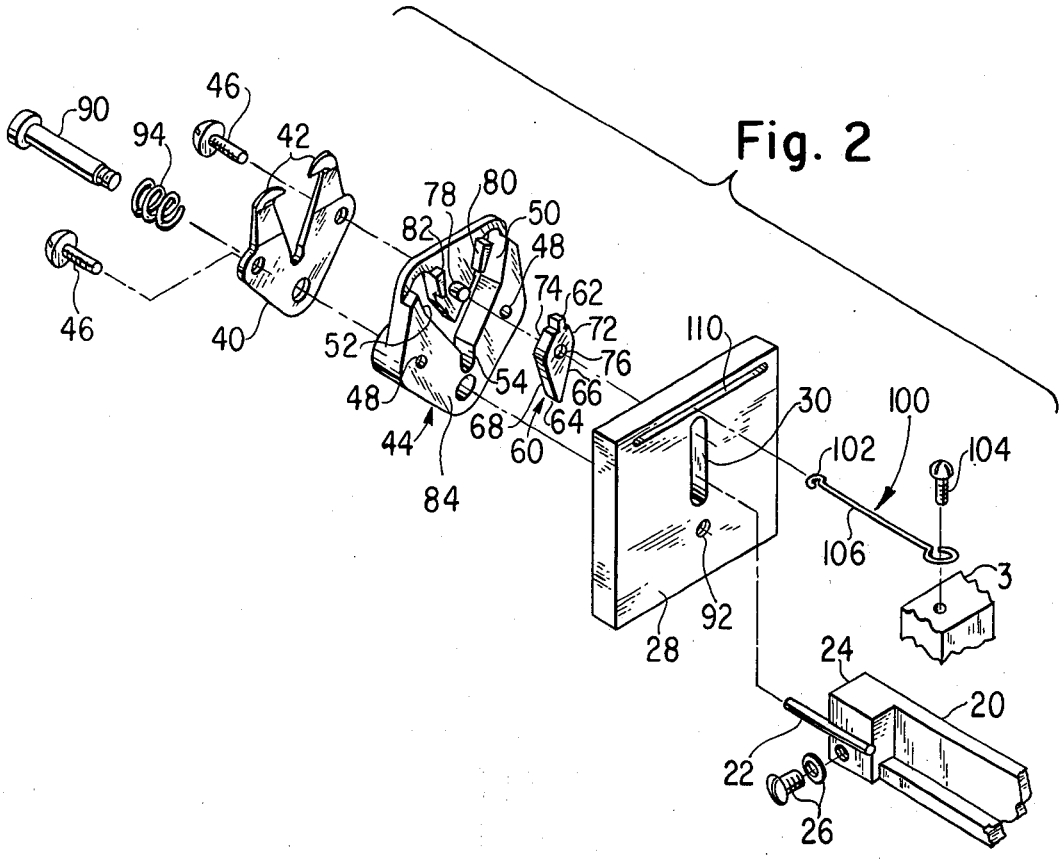
FIG. 2 is an exploded perspective view showing the looper actuating mechanism.

Referring to FIGS. 1 through 11, there is shown a hand held sewing machine 2 having a frame 3, thread carrying needle 4 arranged for reciprocating movement and a double pointed looper mechanism 6 arranged for pivotal movement in cooperation with the needle in the formation of chain stitches. A work piece feed mechanism 8 is arranged to undergo movements in cooperation with those of the needle 4 and the looper mechanism 6, in a notoriously well known manner, to properly position the work piece. A hand operated lever 10, which is pivotally attached at one end 12 to the frame 3 is interconnected with the needle 4 and feed mechanism 8 to impart the desired movements thereto. Such interconnections are well known in the sewing machine art and therefore will not be detailed here.

The hand operated lever 10 also imparts movement to the looper mechanism 6 by imparting vertically reciprocating movement to a drive arm 20 having an actuating member, or drive pin, 22 projecting outwardly from its free extremity 24. The drive pin 22 is held in place by a suitable screw fastener 26. A guide block 28 having a vertically disposed elongated guide channel or hole 30 formed therethrough is rigidly attached to the frame 3. The elongated hole 30 has straight parallel sides and is arranged to slidingly receive the actuating member or drive pin 22 for guiding thereof in the vertical plane.

A double pointed looper 40 having two opposing loop seizing points 42 is securely fastened to an actuating cam 44 by two screw fasteners 46 which are threaded into two holes 48 formed in the cam 44.

A gate member 60, being of generally elongated shape has a tab 62 formed on one extremity, the other extremity having straight sides 66 and 68 that converge to a somewhat pointed abutting end 64. Two abutting surfaces 72 and 74 are formed adjacent opposite sides of the tab 62. The gate member 60 is pivotally attached to the actuating cam 44 by a pin 78 depending therefrom and projecting through a hole 76 formed in the gate member 60 intermediate the two extremities. A pair of bosses 80 and 82 projecting outwardly of said actuating cam 44 are arranged to limit the pivoting movement of the gate 60 with respect to the cam 44 by engaging the abutting surfaces 72 and 74, respectively when the gate 60 is pivoted a sufficient amount in each direction. The gate 60, bosses 80, 82 and pin 78 are slightly recessed below the surface 84 of the cam 44. The actuating cam 44, with attached looper 40, fasteners 46 and gate 60 is pivotally attached, as an assembly, to the guide block 28 by a suitable shoulder screw fastener 90 which is threaded into a hole 92 formed in the guide block 28. A helical compression spring 94 is disposed between the head of the screw fastener 90 and the looper 40 thereby urging the looper and cam assembly toward the guide block 28 so that the surface 84 is maintained in sliding engagement with the guide block.

The actuating cam 44 has formed therein two cam tracks 50 and 52 which intersect at their lower extremities 54. The elongated hole 30 of the guide block 28 is arranged so that the free end of the drive pin 22 projects completely therethrough and into tracking engagement with the intersecting cam tracks 50 and 52. The elongated hole 30 is sufficiently long so that the free end of the drive pin 22 may traverse each of the cam tracks 50 and 52 for their entire lengths.

A gate control spring 100 having a smooth, rounded free end 102 is rigidly attached at its other end to the frame 3 with a screw fastener 104. The shank 106 of the control spring 100 is relatively long and flexible and projects in a direction that is approximately parallel to the axis of the drive pin 22. The free end 102 is arranged to be vertically above the pin 78 and in alignment with the longitudinal axis of the elongated hole 30 when the control spring 100 is in its free state position. The end 102 projects completely through a horizontal clearance slot 110 formed in the guide block 28 at right angles to the elongated hole 30, and interferingly engages the tab 62 of the gate 60. This interfering engagement is best seen in FIGS. 3 through 9*a*.

Figure 1:
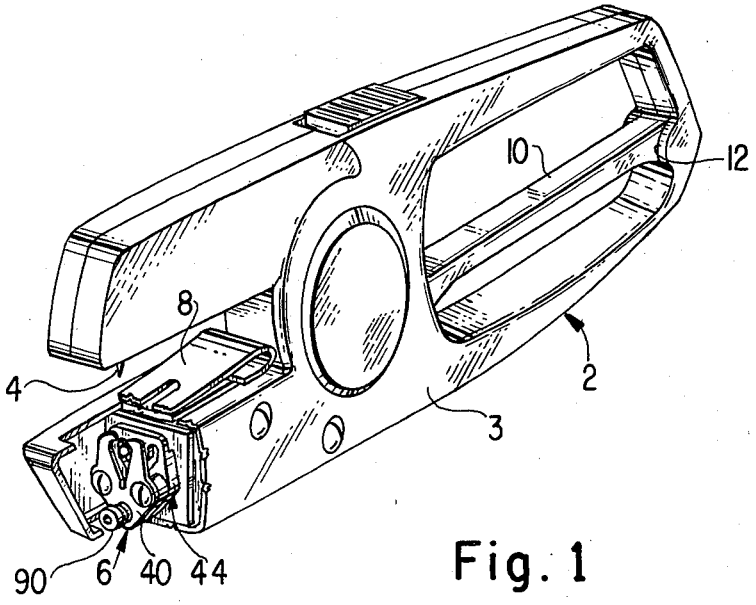
FIG. 1 is a perspective view of a sewing machine illustrating a preferred embodiment of the invention.
Figures 3, 3A, 4, 4A, 5, 5A, 6, 6A, 7, 7A, 8, 8A, 9, 9A:
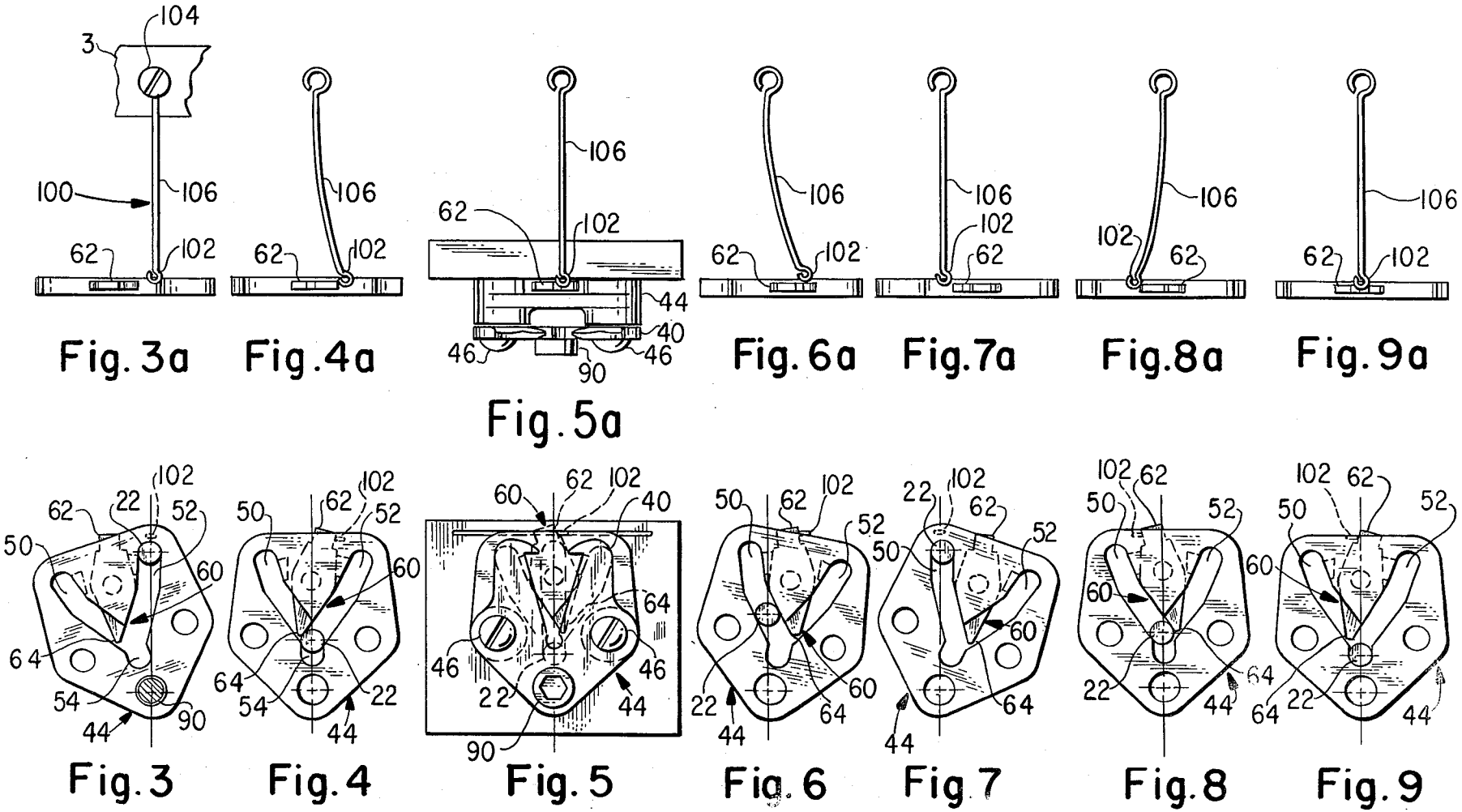
FIGS. 3, 4, 5, 6, 7, 8, and 9 are end views of the looper and actuating mechanism shown in various operating positions.
FIGS. 3*a*, 4*a*, 5*a*, 6*a*, 7*a*, 8*a*, and 9*a* are top views thereof.

Referring to these figures, FIGS. 3, 4, 5, 6, 7, 8, and 9 are all end views of the looper mechanism showing the interaction of the cam 44 and attached looper 40, with the drive pin 22 and the gate 60. FIGS. 3*a*, 4*a*, 5*a*, 6*a*, 7*a*, 8*a*, and 9*a*, are top views projected from FIGS. 3, 4, 5, 6, 7, 8, and 9, respectively, and illustrate the interaction of the gate control spring 100 with the gate 60. FIGS. 3 and 3*a* show the drive pin 22 in the uppermost end of the cam track 52, with the hand lever 10 in its non-operated position as shown in FIG. 1. Note that the pointed end 64 of the gate 60 is tilted so that the cam track 50 is completely blocked. As the hand lever 10 is actuated, the drive pin 22 is caused to track downwardly in the cam track 52, thereby causing the cam 44, and attached looper 40, to pivot clockwise about the screw 90. At the same time, the tab 62 engages the free end 102 of the gate control spring 100, thereby flexing the shank 106 to the right, as seen in FIGS. 4 and 4*a*. At this point the spring 100 is urging the gate 60 to pivot counterclockwise, however, the drive pin 22, as seen in FIG. 4, prevents this pivotal motion. As the actuation of the hand lever 10 continues, the drive pin 22 enters the lower extremity 54 of the two intersecting cam tracks, as shown in FIG. 5. In this position, the pointed end 64 clears the drive pin 22 permitting the gate to pivot counterclockwise so that the cam track 52 is completely blocked. At this point, the hand lever 10 is completely actuated. As the hand lever 10 is permitted to return to its non-actuated position, the drive pin, under the urging of an internal spring that is not shown, begins to track upwardly along the cam track 50, as shown in FIGS. 6 and 6*a*. This causes the cam 44 and attached looper 40 to continue to pivot clockwise thereby again deflecting the shank 106 of the spring 100 to the right. When the hand lever 10 has returned to its non-actuated position, see FIGS. 7 and 7*a*, the drive pin 22 has tracked to the very top of the cam track 50 resulting in the maximum pivotal movement of the cam 44 in the clockwise direction. Concurrently, the shank 106 of the spring 100 is flexed to the right causing the free end 102 to move closer to the screw 104 and further away from the tab 62 of the gate 60 until the free end 102 slips behind the tab 62 and into a relaxed position as shown in FIG. 7*a*. As the hand lever 10 is again actuated, the drive pin 22 begins to track downwardly in the cam track 50 causing the cam 44 and attached looper 40 to pivot counterclockwise about the screw 90. Concurrently, the free end 102 of the gate control spring 100 engages the tab 62 and the shank 106 is thereby deflected to the left as shown in FIGS. 8 and 8*a*. Note that the spring 100 urges the gate 60 to pivot in a clockwise direction, however, the drive pin 22, as seen in FIG. 8, prevents this pivotal motion. As the actuation of the hand lever 10 continues, the drive pin 22 again enters the lower extremity 54, as shown in FIG. 9. In this position the pointed end 64 again clears the drive pin 22 permitting the gate to pivot clockwise so that the cam track 50 is now completely blocked. As the hand lever 10 is permitted to again return to its non-actuated position the drive pin begins to track upwardly along the cam track 52 to complete the cycle.

Figure 11:
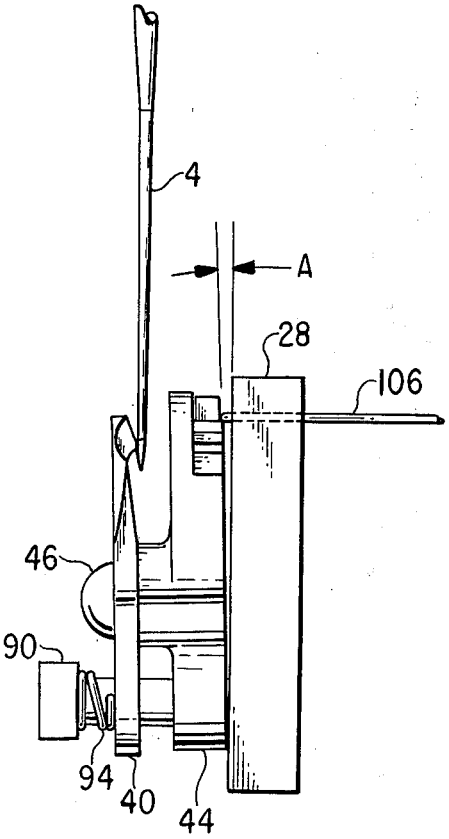
FIG. 11 is similar to FIG. 10 with the needle and looper in engagement.
Figure 10:
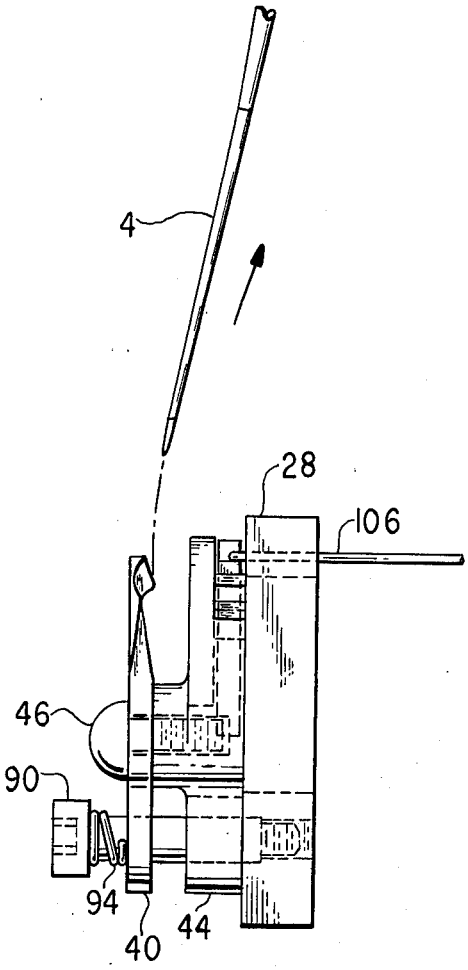
FIG. 10 is a side view showing the needle approaching the looper.

It should be noted that the cam control spring 100 is arranged so that it is sufficiently long to engage the tab 62 for properly pivoting the gate 60 but will slip behind the tab 62, thereby removing its biasing affect, as the cam 44 approaches its maximum pivotal movement in both directions. This effect is further enhanced by the slight tilting of the cam 44 away from the guide block 28, as shown in FIG. 11, when the needle 4 engages the looper 40. As the needle engages the looper, the spring 94 is caused to compress very slightly permitting the cam and looper assembly to tilt a small amount as indicated at A. As the needle 4 is withdrawn, see FIG. 10, the spring 94 urges the cam 44 back into sliding engagement with the guide block 28.

As can be seen, the above described mechanism efficiently and positively converts the vertical reciprocating motion of the drive pin into a controlled back and forth pivoting motion necessary for the proper operation of the double pointed looper. Upon reviewing this disclosure a number of alternative constructions will occur to one skilled in the art. Such constructions may utilize variations in the shape or relative positions of the gate, gate control spring, and the intersecting cam tracks. These constructions, however, are considered to be within the spirit and scope of this invention.

I claim:

1. A sewing machine having a frame, a thread carrying needle arranged for reciprocating motion in said frame, a looper having two loop seizing points and arranged for pivotal motion in said frame, and an actuating means for effecting said motions thereby alternately placing each of said two loop seizing points into cooperative engagement with said needle in the formation of chain stitches, wherein said actuating means comprises:

a. a guide member having an elongated guide channel;

b. an actuating member constrained in said elongated guide channel;

c. means for imparting reciprocatory motion to said actuating member along said elongated guide channel;

d. a cam rigidly attached to said looper, said cam having two intersecting cam tracks;

e. cam follower means associated with said actuating member and arranged in sliding engagement with said cam tracks; and f. a gate means for alternately blocking each of said two intersecting cam tracks so that said cam follower will slidingly engage the other of said two intersecting cam tracks thereby effecting pivotal motion of said looper alternately placing each of said two loop seizing points into cooperative engagement with said needle.

2. The combination of claim 1 wherein said elongated guide channel comprises an elongated opening formed through said guide member and having straight parallel sides.

3. The combination of claim 2 wherein said actuating member comprises a pin extending through said elongated opening and having a free end extending beyond said opening wherein said free end comprises said cam follower means.

4. The combination of claims 1, 2, or 3 wherein said gate means comprises:

a. a cylindrical shaped wire control spring having a fixed end which is rigidly attached to said frame and a free end which is disposed adjacent said cam;

b. an elongated gate member pivotally attached to said cam at a point intermediate the two extremities of said gate member;

c. a tab formed on one of said extremities of said gate member said tab and said spring arranged so that said free end of said spring may occupy a position on one side of said tab urging said elongated gate member to pivot into a first blocking position and said free end may occupy another position on the other side of said tab urging said elongated gate member to pivot into a second blocking position;

d. an abutting end formed on the other of said extremities which is opposite said tab, said abutting end arranged to prevent said sliding engagement of said cam follower means with respect to (1) one of said intersecting cam tracks when said elongated gate member is in said first blocking position, and (2) the other of said intersecting cam tracks when said elongated gate member is in said second blocking position.

* * * * *